US007802851B2

(12) United States Patent
Hyvarinen

(10) Patent No.: US 7,802,851 B2
(45) Date of Patent: Sep. 28, 2010

(54) METHOD AND APPARATUS FOR ADJUSTING MUTUAL POSITION OF CONSTRUCTIONAL ELEMENTS OF A PATIENT CHAIR

(75) Inventor: Pentti Hyvarinen, Helsinki (FI)

(73) Assignee: Planmeca Oy, Helsinki (FI)

( * ) Notice: Subject to any disclaimer, the term of this patent is extended or adjusted under 35 U.S.C. 154(b) by 37 days.

(21) Appl. No.: 11/911,278

(22) PCT Filed: Apr. 11, 2006

(86) PCT No.: PCT/FI2006/050142

§ 371 (c)(1),
(2), (4) Date: Oct. 11, 2007

(87) PCT Pub. No.: WO2006/108923

PCT Pub. Date: Oct. 19, 2006

(65) Prior Publication Data

US 2008/0191536 A1 Aug. 14, 2008

(30) Foreign Application Priority Data

Apr. 11, 2005 (FI) ..... 20050364

(51) Int. Cl.
*A47C 1/10* (2006.01)
*A47C 7/50* (2006.01)

(52) U.S. Cl. ..... 297/409; 297/61; 297/408

(58) Field of Classification Search ..... 297/391, 297/408, 409, 410, 423.11–423.13, 61
See application file for complete search history.

(56) References Cited

U.S. PATENT DOCUMENTS 3,837,704 A * 9/1974 Bauer ..... 297/344.19
3,929,309 A * 12/1975 De Vore ..... 248/118
3,980,373 A * 9/1976 McCormick et al. ..... 439/155
4,834,456 A * 5/1989 Barros et al. ..... 297/403
4,840,429 A 6/1989 Stockl
5,244,254 A * 9/1993 Irwin ..... 297/344.22
5,288,129 A * 2/1994 Nemoto ..... 297/410
5,370,443 A * 12/1994 Maruyama ..... 297/284.1
6,520,585 B1 * 2/2003 Georg et al. ..... 297/408
6,832,882 B2 * 12/2004 Janisch et al. ..... 411/433
7,093,313 B2 * 8/2006 DeBraal et al. ..... 297/408
2003/0030314 A1 * 2/2003 Hummler et al. ..... 297/362.11

FOREIGN PATENT DOCUMENTS

DE 3347255 A1 11/1985
DE 3543980 A1 6/1987
JP 2001008777 A 1/2001
JP 2004229855 A 8/2004

* cited by examiner

*Primary Examiner*—David Dunn
*Assistant Examiner*—Erika Garrett
(74) *Attorney, Agent, or Firm*—Cozen O'Connor

(57) ABSTRACT

The object of the invention is a method and an apparatus for adjusting mutual position of two structural elements of a patient chair, like the back rest and the head rest, articulated with each other, in which method the mutual position of the two structural elements (3, 4, 5) connected with each other by articulation is adjusted by a drive device (13). With the help of the drive device (13) it is possible to produce, for example, an essentially high rotational motion that can be converted to a linear motion with the help of a thread. The linear motion is converted to an essentially slow rotational motion with the help of a thread element (9) functionally connected to an articulated shaft (6, 7) belonging to the position adjustment mechanism.

17 Claims, 3 Drawing Sheets

Figure 1:
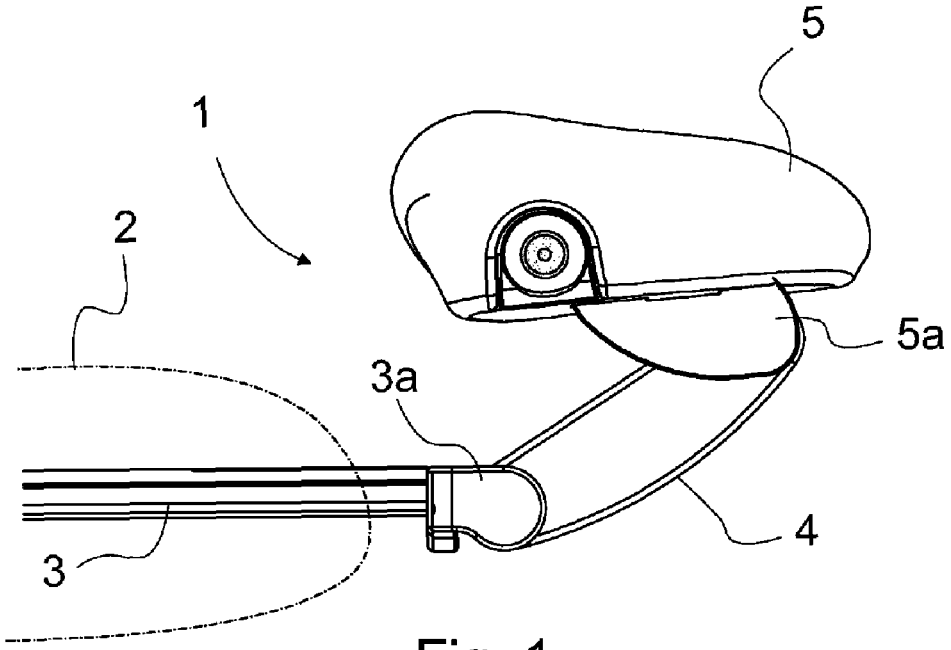

METHOD AND APPARATUS FOR ADJUSTING MUTUAL POSITION OF CONSTRUCTIONAL ELEMENTS OF A PATIENT CHAIR

The object of the present invention is a method defined in the preamble of claim 1 and an apparatus defined in the preamble of claim 8 for adjusting mutual position of two structural elements of a patient chair articulated with each other.

This invention concerns an arrangement of an articulated mechanism of, above all, a patient chair, such as one used in dental care, particularly an articulated mechanism of the head rest of the chair and the pillow belonging to it, but in more general terms the invention is applicable for use in structures comprising two such mechanical elements that are articulated with each other, in which a high or rather high torque caused by an outer load, or the weight of the structure, is impacting the articulation. Hereafter, the method and the apparatus according to invention is called by the joint denomination solution according to the invention.

Typically, a head rest of a patient chair of prior art used in dental care is adjusted according to the height of the patient in longitudinal direction using a slide rail. Here, the head rest is either pulled outwards from the end of the back rest of the chair or pushed inwards as guided by the slide rail. For height adjustment of the head rest, as well as for adjustment of position of the pillow of the head rest, the head rest incorporates an articulated mechanism and a locking mechanism by which the articulated elements can be secured at a desired position. The adjustment is carried out by opening the locking and placing the head rest and the pillow to the correct position by using manual force while the patient's head rests on the pillow. When the correct position has been reached, the head rest and the pillow are secured at their places in the selected position. A problem in these solutions is the heavy position adjustment requiring manual force. In addition, due to the different sizes of patients, in practise, the adjustment must always be carried out anew manually for each patient, possibly also still separately according to the requirements of the care operation or working phase, which manual process with its separate lock opening-adjustment-relocking operations includes several stages and is therefore also time-consuming.

According to prior art, powered head rest adjustment solutions exist, too. A typical problem of them is the big size of the machinery and the power transmission elements, as a consequence of which thickness of the head rest, and possibly also that of the upper part of the back rest, easily becomes impractical in size. In the typical working position of a dentist, or in general of a person in the care work, the lower surface of the back rest has been lowered down to touch, or almost touch, the knees of the care-working person, whereby the thickness of the back rest and/or of the head rest is a decisive factor from the point-of-view of the care-working person. The higher one has to keep the hands, the more straining the care-work.

A problem in these solutions is also the high internal forces existing in the structure, as an outcome of which the position adjustment mechanism easily gives somewhat way downwards. The head rest mechanism should be able to carry without collapsing and, preferably also practically without any yielding, not only the torques caused by masses of the construction itself and of the patient's head, but also those additional torques that it may experience during the care operation. The yield in the mechanism may cause the object of the care operation to move during the operation and thus make the care work more difficult. The possible crashing of the structure also is a security risk, thus there are design rules e.g. for dental patient chairs, according to which they shall have certain load-carrying capacity. The rule relates to static load-carrying capacity, but it would naturally be preferable, though, that a motorized construction would hold, without collapsing, the effect of an exceptional load even in a dynamic situation (and/or in case of a motor break down), even when the torque of the drive-motor would not be arranged to be sufficient for lifting this kind of an exceptional load.

The purpose of this invention is to provide solutions according to the new inventive idea of the invention for controlling problems related to adjustment of the mutual position of structural elements of said patient chair, especially of its head rest. A particular purpose of the invention is to provide such a steady solution for the adjustment of positions of the head rest and pillow of the patient chair that will enable implementing the chair in a way that will enable an ergonomic working position. The purpose is to accomplish such a motorized construction that will still enable arranging e.g. the head rest and/or the back rest thin. A further purpose of the invention is to create a method that is reliable and precise and provides enough power for adjusting mutual positions of the constructional elements of the patient chair. The method according to the invention is characterized by what is presented in the characterising part of claim 1. Respectively, the apparatus according to the invention is characterized by what has been presented in the characterising part of claim 8. The other embodiments of the invention are characterized by what has been presented in the other claims.

The advantage of the solution according to the invention, and of its preferable embodiments, is that they enable implementation of the adjustment mechanism with small-size mechanical components, whereby the invention can be realized as a compact structure in a small space. Thus, e.g. the head rest and/or the back rest of the dental patient chair can, despite the motorization, be implemented as thin, thus allowing the person doing dental work to work keeping hands as low as possible so that they do not fatigue as much as compared with the situation when the back rest and/or the head rest of the chair is thicker and the working position thus less ergonomic. The possibility to use smaller components in the adjustment mechanism also provides the possibility to arrange for them a relatively long motion range in a small space, whereby the position adjustment mechanism enables broad and versatile implementation of adjustment positions. E.g. the motion range of the head rest mechanism can be increased without changing the structural thickness of the head rest itself by just increasing the width of the construction. Another advantage is that with the structural solutions of the invention, and of its preferable embodiments, a great force is provided for adjusting position of the head rest and the pillow in such a way that no great inner forces exist in the machine elements, or in the load-carrying support structures per se that use the adjusting mechanism, whereby they can be small in size and thus inexpensive. Another advantage is the rigid and sturdy structure that does not yield downwards, whereby the structure enables precise work. The solution is safe and self-retaining so that e.g. a failure in the element transmitting force from the drive motor cannot cause e.g. a collapse of the head rest of the patient chair which is articulated according to the invention. Also, overloading the structure in excess of its maximum lifting capacity cannot overload the motor itself. The control of motions of the head rest can be arranged to take place via control by the control system, by e.g. a joystick, or as far as a patient chair used in dental care is concerned, e.g. by a foot control of a dental unit. In case the patient chair is arranged in functional connection with e.g. a control system of a dental unit which includes, or is connected to, a memory including patient information, it is possible to arrange saving of the patient-specific positions of the head rest and the pillow to the memory, too, whereby the correct patient-specific position of the head rest can be selected from the memory and the correct position be quickly, precisely and automatically adjusted.

Figure 2:
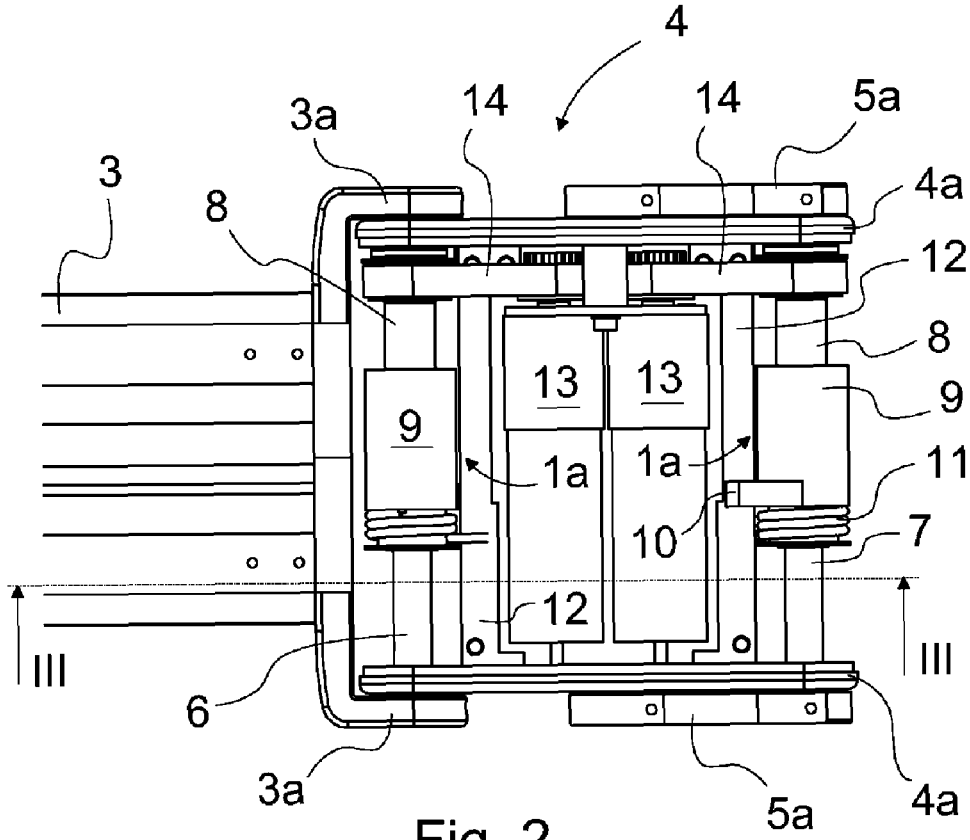
Figure 3:
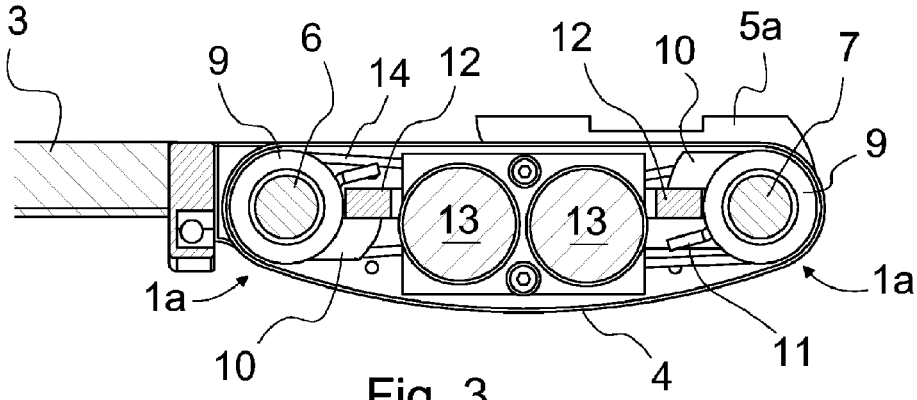
Figure 4:
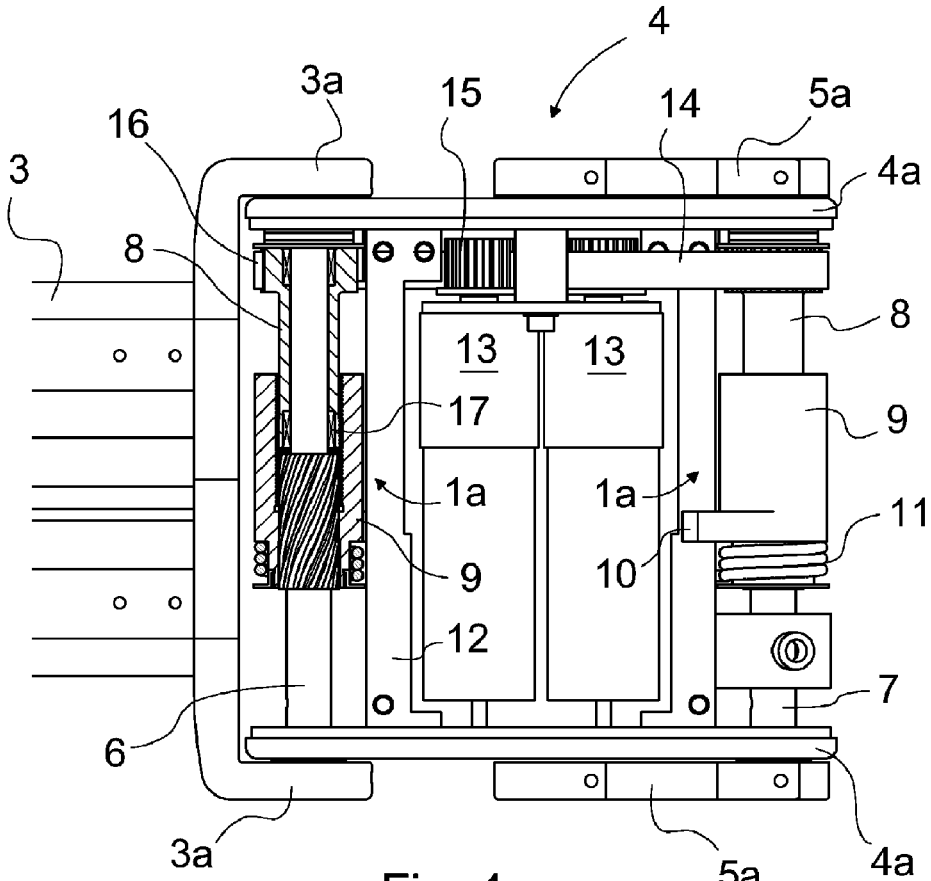
Figure 5:
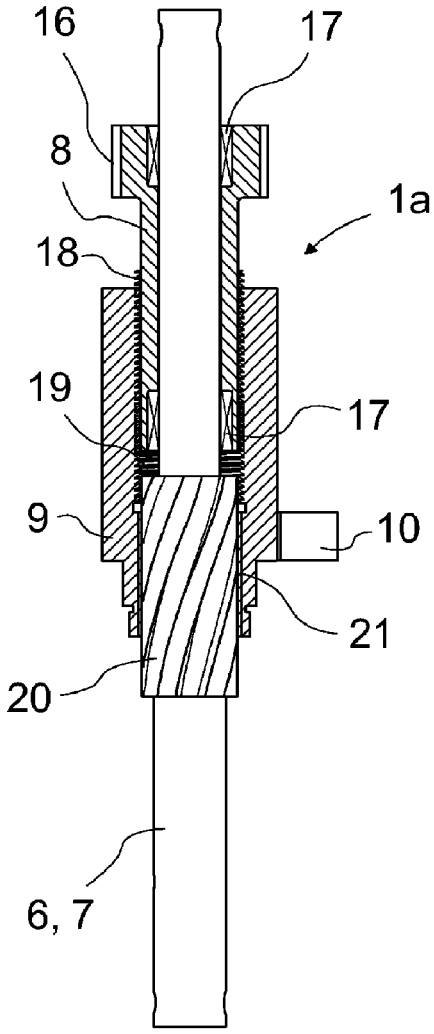
Figure 6:
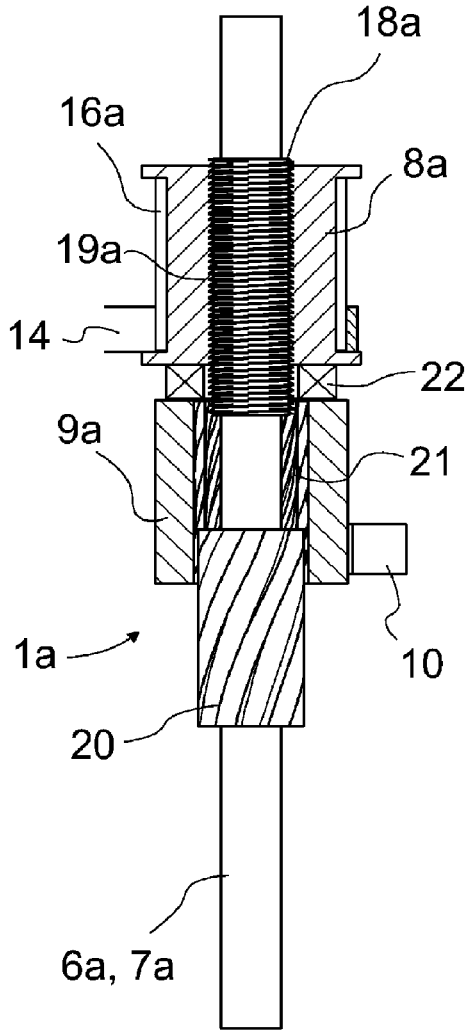

Below, the invention is described in more detail using application-examples and referring to the attached drawings in which FIG. 1 shows a head rest and a pillow of a patient chair seen from the side, FIG. 2 shows the head rest of the patient chair according to FIG. 1 seen from above, pillow-part taken away, FIG. 3 shows the head rest of the patient chair in horizontal position along the cutting line III-III of FIG. 2, seen from the side and with the pillow-part taken away, FIG. 4 shows a head rest applying the invention, seen from above and the pillow-part taken away, and partly cut, FIG. 5 shows an articulated shaft structure according to the invention as simplified and partially cross-sectioned, and FIG. 6 shows another articulated shaft structure according to the invention as simplified and partially cross-sectioned.

FIG. 1 shows a head rest 1 of a patient chair, which is placed at the end of a back rest 2 of the patient chair. The head rest 1 includes an elongated slide element 3 functioning as the first structural element of the articulated structure, equipped at its one end with two fixing lugs 3*a*, and being adapted to slide in its longitudinal direction within the back rest 2 for longitudinal adjustment of the head rest 1. The first end of the actual frame of the head rest 4, functioning as the second structural element of the articulated structure, has been fixed to the fixing lugs 3*a* of the slide element 3, the frame 4 being arranged to turn in a vertical plane for height adjustment of the head rest. Respectively, the pillow-part 5 of the head rest has been articulately fixed to the other end of the frame 4 via articulated shafts 5*a*, the position of the pillow-part being adjustable with respect to the frame of the head rest 4 by turning the pillow-part 5 in a vertical plane about its shafts 5*a*. In this case, the frame of the head rest 4 constitutes the first structural element of the articulated assembly, and the pillow-part 5 with its articulated shaft 5*a* the second.

FIG. 2 shows the neck rest according to FIG. 1 seen from above, the frame 4 turned on a horizontal plane and the pillow-part 5 taken away. The frame 4 consists of two frame elements 4*a*, at a horizontal distance from each other, the first ends of which being connected by an articulated shaft 6 and the second ends by an articulated shaft 7. The articulated shaft 6 extends from both of its ends outside of the frame elements 4*a* and is fixed at said extending ends to the fixing lugs 3*a* at the ends of the slide element 3, as immovable in relation to the slide element 3. Between the articulated shaft 6 and the frame elements 4*a* there is a bearing arrangement that enables turning of the frame 4 round the centre axis of the stationary articulated shaft 6. Respectively, between the articulated shaft 7 and the frame elements 4*a* there is a bearing arrangement, which enables turning of the articulated shaft 7 round its centre axis with respect to frame 4. The articulated shafts 5*a* of the pillow-part 5 have been fixed to the extending ends of the articulated shaft 7 so that when the articulated shaft 7 turns round its centre axis, the articulated shafts 5*a* will follow along. To adjust positions of the frame 4 and the pillow-part 5, both of the articulated shafts 6, 7 are equipped with a special turning mechanism 1*a* according to the idea of the invention, the more detailed construction of which will be described later.

Within the frame 4, a drive motor 13 has been placed for both of the articulated shafts 6, 7 and for the turning mechanisms 1*a* on them, which motors have been arranged to rotate, via cogged belts 14, the drive screws 8, fitted with bearings and functioning as actuator means for the turning mechanisms 1*a*, on the articulated shafts 6, 7. On both of the drive screws 8, fitted to the fine-thread on the drive screw 8, a turning nut 9 functioning as a turning means for the turning mechanism 1*a* has been placed, which along rotation of the drive screw 8 both rotates and moves in axial direction with respect to the articulated shafts 6, 7. In addition, in the turning nut 9 there is a cam 10 extending from its cylinder surface, which has been adapted to press on a fixed stopper 12 in the frame of the head rest 4 during adjustment phase of the head rest 1. A spring 11 has been adapted to resist the turning motion of the turning nut 8 in upward direction and always to return the head rest 1 to its lowest free position, and to keep the assembly as a whole without clearances. The structure of the head rest 1 has been made so that both the frame 4 and the pillow-part 5 recede upwards if they, when being lowered, meet an obstacle, e.g. the knees of a care person. The counter power of the spring 11 has been arranged so low that an evasive motion is possible.

FIG. 3 shows the frame 4 of the head rest 1 without the pillow-part 5 and cut along the cutting line III-III of FIG. 2. The cam 10 of the turning nut 9 on the articulated shaft has been arranged below the fixed stopper 12 on the frame, whereby, in FIG. 3, when the turning nut 9 rotates anti-clockwise, the cam 10 lifts the frame 4 from the stopper 12. Respectively, the cam 10 of the turning nut 9 on the articulated shaft 7 has been arranged above the fixed stopper 12 on the frame, whereby, when the pillow-part 5 is lifted higher, the cam 10 presses on the stopper 12 and the articulated shaft 7 turns round its central axis, in the case according to FIG. 3 clockwise, and lifts the articulated shafts 5*a* upwards.

FIG. 4 shows the frame 4 of the head rest 1 without the pillow-part 5, seen from above and, for clarity, partially cut. The figure shows, among other things, part of the structure of the articulated shaft 6, and of the structures of the drive screw 8 and the turning nut 9 fitted thereon. These structures will be described in more detail in connection with FIG. 5. FIG. 4 also shows the cog-belt-wheel 15 of the drive motor 13, by which the rotating motion of the drive motor 13 is transmitted via a cogged belt to the cogging 16 arranged as fixed at the end of the drive screw 8.

FIG. 5 shows, as cross-sectioned and seen from above, the articulated shaft 6 and, placed on the articulated shaft, the drive screw 8 and the turning nut 9 belonging to the turning mechanism 1*a* of a preferable embodiment of the invention. The articulated shaft 7, together with its components, is of similar structure. In axial direction, approximately at the centre of the articulated shafts 6, 7 there is a part with a diameter which is larger than that of the other parts of the articulated shaft, and which incorporates an essentially high-pitched outer thread 20, functioning as a part of the turning mechanism 1*a* and having a pitch which may be, for example, at least 40 mm, like about 100 mm. Respectively, at the first end of the turning nut 9 there is a high-pitched inner thread 21, being fitted with the outer thread 20, and at the second end an essentially low-pitched inner thread 19, the diameter of which being larger than the diameter of the high-pitched inner thread 21. The pitch of the low-pitched inner thread 19 may be, for example, between 0.5 to 5 mm, like about 1 mm.

The drive screw 8 is fitted at both of its ends with bearings 17 to be rotative on the articulated shaft 6, 7. At the first end of the drive screw 8 there is a cogging 16 with a larger diameter than that of the rest part, adapted to function in connection with the cogged belt 14. At the second end of the drive screw 8, at its elongated body part, there is an essentially low-pitched outer thread 18 the diameter and pitch of which have been arranged to fit those of the low-pitched inner thread 19 of the turning nut 9.

The structure operates so that when the drive motor 13 rotates the drive screw 8, which is arranged as axially fixed to the articulated shaft, via the cogged belt 14, the drive screw 8 moves the turning nut 9 in axial direction of the articulated shaft 6, 7, whereby it also turns about the articulated shaft 6, 7 as guided by the high-pitched thread 20, 21. The first direction of rotation of the drive motor 13 causes pressing of the cam 10 against the stopper 12 and rising of the frame of the head rest 4 and the pillow-part 5 upwards. Respectively, the second direction of rotation releases the cam 10 from the stopper 12 and causes descending of the frame of the head rest 4 and the pillow-part 5 as a consequence of influence of gravity, including that possibly caused by the patient's head resting on the pillow-part. The spring 11 supports the influence of gravity and eliminates clearances.

FIG. 6 shows the articulated shaft 6*a*, 7*a* according to another preferable embodiment of the invention, seen from above, and the turning mechanism 1*a* according to the invention fitted on the articulated shaft, in which Fig. the drive screw 8*a* and the turning nut 9*a* have been shown as cross-sectioned. In axial direction, approximately from the centre of the articulated shaft 6*a*, 7*a* towards the first end of the articulated shaft, there is a part with a diameter larger than that of the rest part of the articulated shaft, having an essentially high-pitched outer thread 20 functioning as part of the turning mechanism 1*a*, which thread may be alike the outer thread 20 of the shaft 6, 7 described above. Respectively, the turning nut 9*a* incorporates a high-pitched inner thread 21 fitted with the outer thread 20. In addition, in axial direction, approximately from the centre of the articulated shaft 6*a*, 7*a* towards the second end of the articulated shaft, there is a part with larger diameter than that at the ends of the articulated shaft, having an essentially low-pitched outer thread 18*a*, which may be alike the outer thread 18 of the drive screw described above. Respectively, the drive screw 8*a* incorporates a low-pitched inner thread 19*a* adapted to this outer thread 18*a*. The drive screw 8*a* is of an elongated shape and has on its outer perimeter a cogging 16*a* essentially of the length of the drive screw for rotating the drive screw about its central axis with the help of the cogged belt 14. In addition, at both ends of the drive screw 8*a* there are flanges with diameters larger than that of the cogging 16*a*, which prevent the cogged belt 14 from dropping off from the cogging. Between the drive screw 8*a* and the turning nut 9*a* there is a thrust bearing 22.

The structure operates so that when the drive motor 13 rotates the drive screw 8*a* by the cogged belt 14, the drive screw 8*a* is moved in the axial direction of the articulated shaft 6*a*, 7*a* by the low-pitched fine-thread while the cogged belt 14 glides axially on the cogging 16*a*. While revolving and simultaneously moving in axial direction, the drive screw 8*a* pushes the turning nut 9*a* via the thrust bearing 22 in the axial direction of the articulated shaft 6, 7, whereby the turning nut 9 turns, simultaneously with its linear motion, about the articulated shaft 6*a*, 7*a* as guided by the high-pitched thread 20, 21. The first direction of rotation of the drive motor 13 causes compression of the cam 10 against the stopper 12, and rising of the frame of the head rest 4 and the pillow-part 5 upwards. Respectively, the second direction of rotation detaches the cam 10 from the stopper 12 and causes descending of the frame of the head rest 4 and the pillow-part 5 due to the influence of gravity, including that possibly caused by the patient's head resting on the pillow-part. The spring 11 supports the influence of gravity and pushes the turning nut 9*a* towards the drive screw 8*a* and, at the same time, eliminates clearances.

Independently from the structures of the drive screw 8, 8*a* of the turning mechanism, of the turning nut 9, 9*a* and of the high-pitched thread 20, their dimensions and pitches have been fitted in relation to each other in a way which realizes the idea of the invention so that the transmission ratio of the turning mechanism becomes essentially high. The structure according to the invention realized in this way, including a structure of a gear integrated with the articulated shaft, is already in itself self-retaining, thus there is no need to arrange any other means to the position adjustment mechanism to achieve self-reticence and, thus, there is no need for locking the adjustment positions. The invention provides an articulated operation which is compact, that is, can be arranged in a small space, has a good efficiency and which can be directly integrated with the articulated shaft, with the characteristics of being able to transfer a great torque and which is self-retaining. In addition, it provides means to prevent overloading of the drive motor.

In view of e.g. the typical dimensions of the head rest of a patient chair used in connection with dental care, the transmission ratio of the gear integrated with the articulated shaft according to this invention is preferably about 100, when the length of the high-pitched thread on the articulated shaft is of the order of 40 mm. The angle of rotation achievable by the structure may be increased by lengthening the thread, and/or, for example, arrange the pitch angle of the low-pitched thread to be even smaller. The ratio of the low- and high-pitched threads as described above is thus preferably essentially high, like at least N×10:1, where N is at least two, such as of the order of 10.

In the method according to the invention, the position of the head rest 1 is adjusted by adjustments of positions of the frame 4 and the pillow-part 5 e.g. as follows: To lift the frame of the head rest 4 upwards, the drive motor is driven in such a way that an essentially fast rotational motion is produced, which is transmitted via the cogged belt 14 and the coggings 15, 16 to a rotational motion of the drive screw 8, 8*a*, which rotational motion is converted by the low-pitched thread 18, 19*a* to an axial motion, by which axial motion the turning nut 9, 9*a* is moved on the articulated shaft 6, 6*a*, 7, 7*a* in the axial direction of the articulated shaft as guided by the high-pitched outer thread 20 on the articulated shaft, whereby, at the same time, in addition to the linear movement, the turning nut 9, 9*a* revolves about its rotational axis. In such a way, the rotational motion of the drive motor 13 is arranged to provide a linear movement, which is converted to an essentially slow rotational motion with the help of the turning nut 9, 9*a* and the corresponding high-pitched thread arranged in the articulated shaft.

While the turning nut 9, 9*a* turns further, its cam 10 is directed to meet the stopper 12 situated in the frame 4 in such a way that the cam 10 of the turning nut 9, 9*a* on the articulated shaft 6, 6*a* presses against the stopper 12 and, thus, turns the frame 4 to a vertical position. Respectively, the cam 10 of the turning nut 9, 9*a* on the articulated shaft 7, 7*a* presses against the stopper 12 and, thus, turns the articulated shafts 5*a* of the pillow-part 5 to a vertical position. In order to lower the frame 4 and the pillow-part 5 downwards, the drive motor 13 is rotated in the opposite direction, the cam 10 of the turning nut 9, 9*a* is driven to a desired position, and the frame 4 and the pillow-part 5 are let to settle to the desired position with the help of gravity and the spring 11.

Above, the invention has been described with the help of its preferable embodiment, in which linear movement of the turning nut has been realized by converting rotational motion of the drive motor to an axial motion of the turning nut with the help of a low-pitched thread arranged in the rotative turning screw, and the corresponding thread arranged in the turning nut. Although this solution is, due to its mechanical simplicity, an especially preferable embodiment of the invention, in principle, the axial movement of the turning nut may, however, be realized by any arrangement producing sufficient axial force to drive the turning nut in axial direction of the articulated shaft as guided by an essentially high-pitched thread.

On the other hand, it can be stated that when, in the above, terms like turning nut and turning screw, among others, have been used for parts of the apparatus, one could just as well speak more generally about e.g. the first and the second thread elements. For example, the term turning screw could be interpreted in this context rather in an illustrative way than as a concrete screw since, as a matter of fact, the machine element providing a corresponding function does not necessarily have to be "screw-like" at all. Further, the more general term machine element may be used for the part incorporating the high-pitched thread of the articulated shaft.

It is clear to a man skilled in the art that different embodiments of the invention are not limited to the examples described above but may vary within the claims to be presented below. So, for example, the drive motors of the drive screws may also be placed elsewhere than in the frame part of the head rest. One suitable place is e.g. within the frame of the slide element and the back rest of the patient chair.

Likewise, the mutual structure and adaptation of the drive screw and the turning nut on the articulated shaft may be different from what has been presented above. In the embodiment using the drive screw, it is essential that the essentially high-speed rotational motion is converted to a linear motion, and the linear motion brought about in this way is changed to a slow rotational motion. Further, it is clear to a man skilled in the art that, instead of the cogged belt, other power transmission solutions may be used in the solutions according to the invention, too.

The solution according to the invention may be equipped with a memory means and a control for automatically driving the articulated mechanism to a desired adjustment position on the basis of patient-specific information saved in the memory. The invention may be applied for adjusting other than the head rest structures of a patient chair as well, as e.g. for adjusting position of hand rests, of a back rest or, of a possibly of the seat part separate foot rest.

It is clear to a man skilled in the art that the inventive content of the application can also consist of several separate inventions, and the inventive content in this application may also be defined in another way than what has been done in the claims that follow. In that case, some of the definitions included in the claims below may be unnecessary as far as the separate inventive ideas are concerned. The characteristics of the different embodiments of the invention may, within the basic idea of the invention, also be applied in connection with other embodiments.

The invention claimed is:

1. A method for adjusting mutual position of two structural elements of a patient chair, which structural elements are connected to each other by an articulated shaft, in which method said mutual position of said two structural elements is adjusted by a drive device arranged to produce a linear motion, which linear motion is converted to a slow rotational motion of a first thread element arranged in connection with said articulated shaft, wherein said linear motion is produced with the help of the drive device producing rotational motion and of a second thread element which changes the rotational motion to an axial motion on said articulated shaft, wherein an essentially fast rotational motion is produced by said drive device to said second thread element, and wherein said essentially fast rotational motion produced by the drive device is converted to a linear motion of said first thread element in said second thread element by an essentially low-pitched thread element, which linear motion is further converted, in said first thread element and with the help of essentially high-pitched threads on the articulated shaft, to an essentially slow rotational motion of the first thread element.

2. The method according to claim 1, wherein the ratio between said essentially fast and slow rotational motions is of the order of 100:1.

3. A method according to claim 1, wherein a position of a head rest of the patient chair is adjusted by said essentially slow rotational motion of the first thread element.

4. A method according to claim 3, wherein two articulated shafts are arranged in connection with the head rest of the patient chair, the first of which is arranged between the back rest of the chair and the frame of the head rest, and the second between the frame of the head rest and the pillow-part, and that the positions of said frame and pillow-part are adjusted according to claim 1.

5. The method of claim 1, wherein the drive device and the articulated shaft are situated on a frame.

6. The method of claim 1, wherein the first thread element is mounted of on the articulated shaft.

7. An apparatus for adjusting mutual position of two structural elements of a patient chair that are articulated with each other, which apparatus comprises an articulated shaft and a drive device, by the drive force of which the mutual positions of the structural elements, joined together by said articulated shaft, have been arranged to be adjusted, wherein said articulated shaft functionally incorporates a first thread element equipped with an essentially high-pitched thread and a machine element equipped with a corresponding thread and being in functional connection with the second of said structural elements, and that said first thread element has been arranged to be moved in axial direction of the articulated shaft with the help of power taken from said drive device.

8. An apparatus according to claim 7, wherein said drive device is a device producing rotational motion and that the apparatus includes a second thread element, which has been arranged to convert said rotational motion to a linear motion of said first thread element.

9. An apparatus according to claim 8, wherein the ratio of pitch-angles of said first and second thread element is essentially high, at least N×10:1, where N is at least two, in the order of 10.

10. An apparatus according to any of the claim 7, wherein it comprises a turning mechanism including at least a first thread element equipped with an essentially high-pitched inner thread and second thread element driven by a drive device, which second thread element is adapted to move the first thread element in the axial direction of the articulated shaft, and that said machine element with high pitched thread is an essentially high-pitched outer thread belonging to the turning mechanism, on which thread the first thread element is arranged to move linearly as driven by the second thread element and, at the same time, to turn about its rotation axis as guided by said high-pitched outer thread.

11. An apparatus according to claim 10, wherein the articulated shaft is equipped with an essentially high-pitched outer thread, and that both the second thread element and the first thread element are fitted on the articulated shaft to rotate about the central axis of the articulated shaft.

12. An apparatus according to claim 10, wherein the second thread element is equipped with an essentially low-pitched thread for achieving linear movement of the first thread element.

13. An apparatus according to claim 10, wherein on the outer surface of the cylindrical part of the second thread element there is an essentially low-pitched thread, and that at the end of the second thread element of the first thread element there is a corresponding, essentially low-pitched thread, and that said threads have been mutually adapted so that while the second thread element rotates, the first thread element is arranged to move axially on the articulated shaft as guided by the threads.

14. An apparatus according to claim 10, wherein on the inner surface of the cylindrical part of said second thread element there is an essentially low-pitched thread, and that the articulated shaft is equipped with an essentially low-pitched outer thread corresponding the thread, and that the second thread element has been arranged to be rotated on the articulated shaft as guided by the thread in question arranged to the articulated shaft and, thus, to move linearly and at the same time to push the first thread element in front of it on the articulated shaft.

15. An apparatus according to claim 10, wherein the turning mechanism has been placed as an articulated mechanism in a patient chair, equipped with a head rest, for adjusting position of the head rest.

16. An apparatus according to claim 15, wherein one turning mechanism is placed to the head rest of the patient chair for adjusting position of a frame of the head with respect to the back rest of the chair, and a second turning mechanism for adjusting position of the pillow-part of the head rest with respect to the frame of the head rest.

17. A method for adjusting mutual position of two structural elements of a patient chair, which structural elements are connected to each other by an articulated shaft, in which method said mutual position of said two structural elements is adjusted by a drive device arranged to produce a linear motion, which linear motion is converted to a slow rotational motion of a first thread element arranged in connection with said articulated shaft, wherein said linear motion is produced with the help of the drive device producing rotational motion and of a second thread element which changes the rotational motion to an axial motion on said articulated shaft, wherein an essentially fast rotational motion is produced by said drive device to said second thread element, and wherein the ratio between said essentially fast and slow rotational motions is of the order of 100:1.

* * * * *